US005755592A

United States Patent [19]

Hillbish et al.

[11] Patent Number: 5,755,592

[45] Date of Patent: May 26, 1998

[54] COMBINED GROUND STRAP AND BOARD LOCK FOR ELECTRICAL CONNECTOR ASSEMBLY

[75] Inventors: Warren Christian Hillbish, Hummelstown; William Gary Lenker, Marysville; Jeffrey Byron McClinton, Harrisburg, all of Pa.

[73] Assignee: The Whitaker Corporation, Wilmington, Del.

[21] Appl. No.: 721,485

[22] Filed: Sep. 27, 1996

[51] Int. Cl.[6] ..... H01R 13/60; H01R 13/66

[52] U.S. Cl. ..... 439/541.5; 439/939

[58] Field of Search ..... 439/101, 108, 439/541.5, 567, 571, 572, 607, 939

[56] References Cited

U.S. PATENT DOCUMENTS

| | | | |
|---|---|---|---|
| Re. 35,039 | 9/1995 | Masuda et al. | 29/876 |
| D. 377,336 | 1/1997 | Tan et al. | D13/147 |
| 4,673,237 | 6/1987 | Wadsworth | 439/607 |
| 4,911,659 | 3/1990 | Viselli | 439/570 |
| 5,024,607 | 6/1991 | Kachlic | 439/567 |
| 5,037,330 | 8/1991 | Fulponi et al. | 439/607 |
| 5,044,984 | 9/1991 | Mosser et al. | 439/540 |
| 5,080,609 | 1/1992 | Fabian et al. | 439/540 |
| 5,085,590 | 2/1992 | Galloway | 439/95 |
| 5,102,350 | 4/1992 | Janota et al. | 439/607 |
| 5,145,407 | 9/1992 | Obata et al. | 439/571 |
| 5,161,999 | 11/1992 | Broschad, III et al. | 439/567 |
| 5,167,531 | 12/1992 | Broschard, III et al. | 439/540 |
| 5,254,010 | 10/1993 | Davis | 439/108 |
| 5,318,463 | 6/1994 | Broschard, III et al. | 439/540 |
| 5,356,297 | 10/1994 | Haskins | 439/58 |
| 5,407,366 | 4/1995 | Briones et al. | 439/639 |
| 5,489,219 | 2/1996 | Fabian | 439/567 |
| 5,547,385 | 8/1996 | Spangler | 439/108 |
| 5,643,008 | 7/1997 | Tan et al. | 439/541.5 |

FOREIGN PATENT DOCUMENTS

| | | | |
|---|---|---|---|
| 0627793 A1 | 12/1994 | European Pat. Off. | H01R 23/70 |
| 0584937 | 2/1994 | United Kingdom | 439/607 |

OTHER PUBLICATIONS

International Search Report mailed Jan. 15, 1998 in corresponding PCT/US97/16982; three pages.

Foxconn Drawing No. 301–0100–465, "Connector, Game/Audio Dual Port D–Sub . . . Audio Jack"; one page; (1995); Hon Hai Precision Ind. Co. Ltd., Taipei, Taiwan, ROC.

*AMP Catalog* 65445, "Amplimite HD–20 Subminiature D Stacked PCB Connectors Series I, Series I and Hybrid Styles", 16 pages; Sep. 1992; AMP Incorporated, Harrisburg, PA.

*AMP Catalog* 82208, "Amplimite .050 Series Connectors, Series III"; pp. 24, 74,75; Dec. 1994; AMP Incorporated, Harrisburg, PA.

*Primary Examiner*—Neil Abrams
*Assistant Examiner*—Katrina Davis
*Attorney, Agent, or Firm*—Anton P. Ness

[57] ABSTRACT

A connector assembly (10) including at least one audio jack (36,38,40) stacked in an insulative housing spacer (24) with an electrical connector (80). The connector assembly is arranged for surface mounting to a circuit board (12) which is orthogonal to a metal panel (14) having openings (16,18, 20,22) which provide access to the audio jacks and to the connector of the connector assembly. The electrical connector includes a forward mating end (92) surrounded by a metal shroud (98) which engages the metal panel. To ground the shroud to the circuit board, a combined ground strap and board lock (90) has one end secured to the circuit board and another end (116) clamped between the housing and a rearwardly extending tab (118) of the shroud.

11 Claims, 4 Drawing Sheets

COMBINED GROUND STRAP AND BOARD LOCK FOR ELECTRICAL CONNECTOR ASSEMBLY

FIELD OF THE INVENTION

This invention relates to electrical connector assemblies which are adapted for surface mounting to a circuit board and, more particularly, to a combined ground strap and board lock for such a connector assembly.

BACKGROUND OF THE INVENTION

Electrical connector assemblies are often surface mounted to a printed circuit board To conserve space on the circuit board, such assemblies often include stacked connectors. In order to minimize electrical noise and provide for electrostatic discharge, the individual connectors are typically grounded to the circuit board. In a stacked configuration of connectors, a relatively long ground strap must be provided for the connector furthest from the board. It is also known to provide a board lock for a connector assembly which is connected at one end to the connector assembly and passes at its other end through a suitable opening in the circuit board, the board lock having interfering barbs which resist its subsequent removal from the opening before eventual soldering. The board lock thus stabilizes and secures the connector assembly to the circuit board while connector contacts are soldered to the circuit board and the assembly is otherwise secured thereto. To conserve space on the circuit board, it would be desirable to provide an element which functions both as a ground strap and as a board lock.

SUMMARY OF THE INVENTION

According to the present invention, there is provided an electrical connector assembly adapted for surface mounting to a circuit board which comprises an electrical connector including an insulating connector housing having a forward mating end for engagement with a complementary mating connector, a plurality of contacts disposed in the connector housing and exposed at the forward mating end in a defined array for frictional engagement with respective contacts of the mating connector, and a metal shroud surrounding the forward mating end for shielding the plurality of contacts. The assembly also comprises an insulative housing spacer having a mounting face for engaging the circuit board and an upper face parallel to and spaced from the mounting face. The connector housing is mounted to the upper face of the housing spacer. A combined ground strap and board lock is provided which includes a conductive metal strip having at least one outwardly extending barb along a lateral edge at a first end of the strip for interfering engagement with a hole in the circuit board. The other end of the metal strip conductively engages the metal shroud.

In accordance with an aspect of this invention, the metal strip is formed at its first end with a pair of spaced parallel longitudinally extending tines each having at least one outwardly extending barb on a lateral edge.

In accordance with another aspect of this invention, the metal strip includes on each lateral edge at the first end at least one outwardly extending barb, and preferably between the barbs on opposed lateral edges the metal strip is formed with at least one longitudinally extending closed-end slot allowing temporary inward deflection of two opposed portions of the first end during insertion through a circuit board mounting hole.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
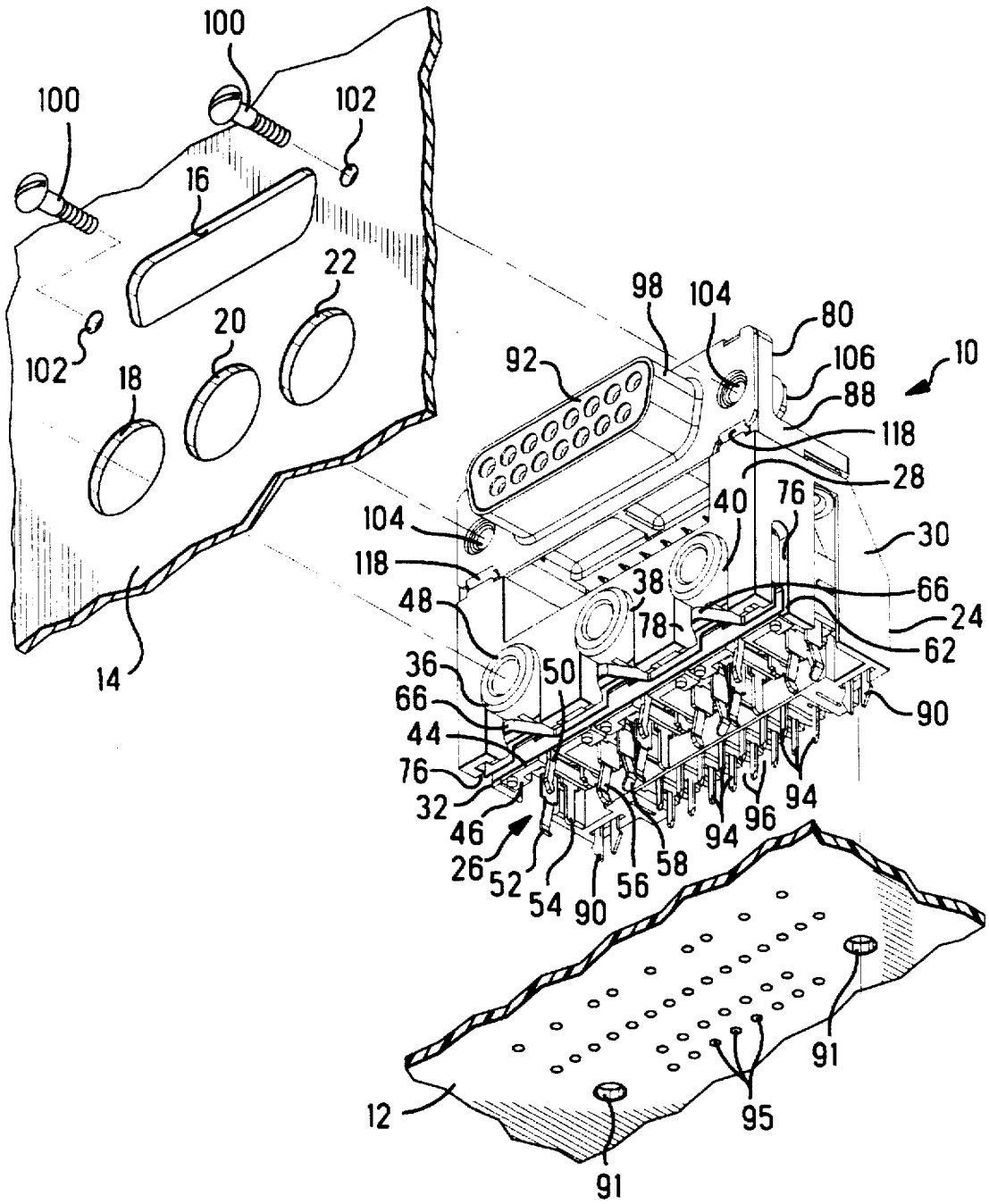
FIG. 1 is a fronts bottom and right side isometric view of a connector assembly constructed in accordance with the principles of this invention, showing portions of a circuit boards the metal panel of a computer or other electronic equipment, and a first embodiment of the inventive combined ground strap and board lock.

Referring to the drawings, shown therein is a connector assembly, designated generally by the reference numeral 10, and constructed in accordance with the principles of this invention, for mounting on the circuit board 12. In the illustrative embodiment, the circuit board 12 is within a piece of electronic equipment, such as a personal computer, the outer case of which includes a metal panel 14 which is orthogonal to the circuit board 12. The panel 14 is formed with a plurality of openings 16,18,20,22 through which the connector assembly 10 is accessible. Accordingly, the personal computer (or other electronic equipment) may interface through the connector assembly 10 with various pieces of external equipment, which in general is well known in the art.

The connector assembly 10 includes an insulative housing spacer 24 which has a mounting face 26 adapted for engaging the circuit board 12 and a front wall 28 which is orthogonal to the mounting face 26 and parallel to the panel 14. A pair of opposed parallel side walls 30,32 each extends orthogonally from the mounting face 26 and from the front wall 28. Accordingly, there is defined an internal cavity 34 of the housing spacer 24 which is flanked by the mounting face 26, the front wall 28 and the side walls 30,32. As will be clear from the following discussion, the cavity 34 communicates with the mounting face 26 and the front wall 28.

As shown, three laterally aligned audio lacks 36,38,40 are disposed in the cavity 34. The jacks 36,38,40 are identical, so only the jack 36 will be described. The jack 36 includes an insulative body 42 having a front face 44, a lower face 46 and a plug receptacle 48 extending from the front face 42. As is conventional, the plug receptacle 48 is adapted for receipt of an audio plug. When mounted to the circuit board 12, the plug receptacle 48 of each of the audio lacks 36,38,40 is accessible through a respective one of the openings 18,20,22 of the panel 14. The audio jack 36 further includes a plurality of contact terminals 50,52,54,56,58 extending from the lower face 46 and through the housing mounting face 26 for connection to the circuit board 12 in a conventional manner. Such audio jacks may be, for example, of the type disclosed in U.S. Pat. No. Re. 35,039. Optionally, in view of the close spacing of audio jacks 36,38,40 in the present assembly 10, it may be desired for contact terminals 56,58 of each jack to be of a straight or inwardly bent design, to maximize spacing from the contact terminals of adjacent audio jacks and minimize the possibility of solder bridging therebetween on the circuit board and resultant short circuits, due to such close spacing in assembly 10.

The terminal 50 is a ground terminal and has a projection (not shown) which extends outwardly from, and is exposed at, the front face 44. A conductive ground clip 62 is provided which extends between the side walls 30,32 of the housing 24 and is captured between the housing front wall 28 and the audio jack front face 44. The ground clip 62 engages the projection of the audio jack ground terminal 50. The ground clip 62 is a piece of sheet metal formed into a U-shape when viewed in a plane parallel to the housing side walls 30,32. Along a first side 64 of the U-shape, the ground clip 62 has an L-shaped cut so that a tab 66 is bent forwardly away from the side 64 to function as a spring arm. Preferably, there are three such tabs 66, each corresponding to a respective one of the audio jacks 36,38,40. In addition, the side 64 of the ground clip 62 is cut away and bent to form a pair of interfering barbs 68. Further, the opposite side 70 of the ground clip 62 is formed with three openings, each associated with a respective one of the jacks 36,38,40. Each of the openings is arranged to receive a respective projection of a respective ground terminal 50.

The housing front wall 28 is formed with three arched openings 74 through which the audio jack plug receptacles 48 and the tabs 66 of the ground clip 62 are accessible. In particular, the plug receptacles 48 and the tabs 66 extend through respective ones of the openings 74 forwardly beyond the front wall 28 of the housing spacer 24 so that the plug receptacles 48 are within the respective ones of the openings 18,20,22 of the panel 14 and the tab 66 contacts the inner surface of the panel 14.

During assembly, the audio jacks 36,38,40 are inserted into the cavity 34 of the housing spacer 24 through an open region of the mounting face 26. The arched openings 74 are open to the mounting face 26 so as to receive the outwardly extending audio jack plug receptacles 48. The outer surfaces of the audio jacks 36,38,40 and the inner surface of the housing spacer 24 are formed with interfering parts (not shown), as is conventional, so that the audio jacks 36,38,40 may be snap fit into the housing spacer 24. The ground clip 62 is then inserted between the front faces 44 of the audio jacks 36,38,40 and the inner surface of the front wall 28 of the housing spacer 24. The openings 74 receive the spring arms 66. Such insertion is with the open side of the U-shape of the ground clip 62 toward the mounting face 26 of the housing spacer 24, as is clear from the drawings. The side walls 30,32 of the housing spacer 24 are formed with elongated slots 76 open to the mounting face 26 to aid in insertion of the ground clip 62. The ground clip 62 is inserted until its closed end abuts the plug receptacles 48. At that time, the projections of the ground terminals 50 snap into respective openings of the ground clip 62 and the barbs 68 snap outwardly past interfering projections on the rear surface of the front wall 28 between the openings 74. Therefore, once installed, the ground clip 62 is not easily removed The connector assembly 10 further includes an electrical connector 80 mounted to the top of the housing spacer 24. Illustratively, the connector 80 may be used as a game port connector for a computer and may comprise an AMPLIMITE 15-position connector manufactured by AMP Incorporated of Harrisburg, Pa. The connector 80 includes an insulating housing 82 supported on the upper face 84 of the housing spacer 24 and secured thereto by rivets 86 extending through aligned openings 87 in flanges 88 of the housing 82 and openings 89 in the housing spacer 24. As will be described in full detail hereinafter, captured between the flanges 88 and the upper face 84 are combined ground straps and board locks 90 which are snap fit through suitable openings 91 in the circuit board 12.

Figure 2:
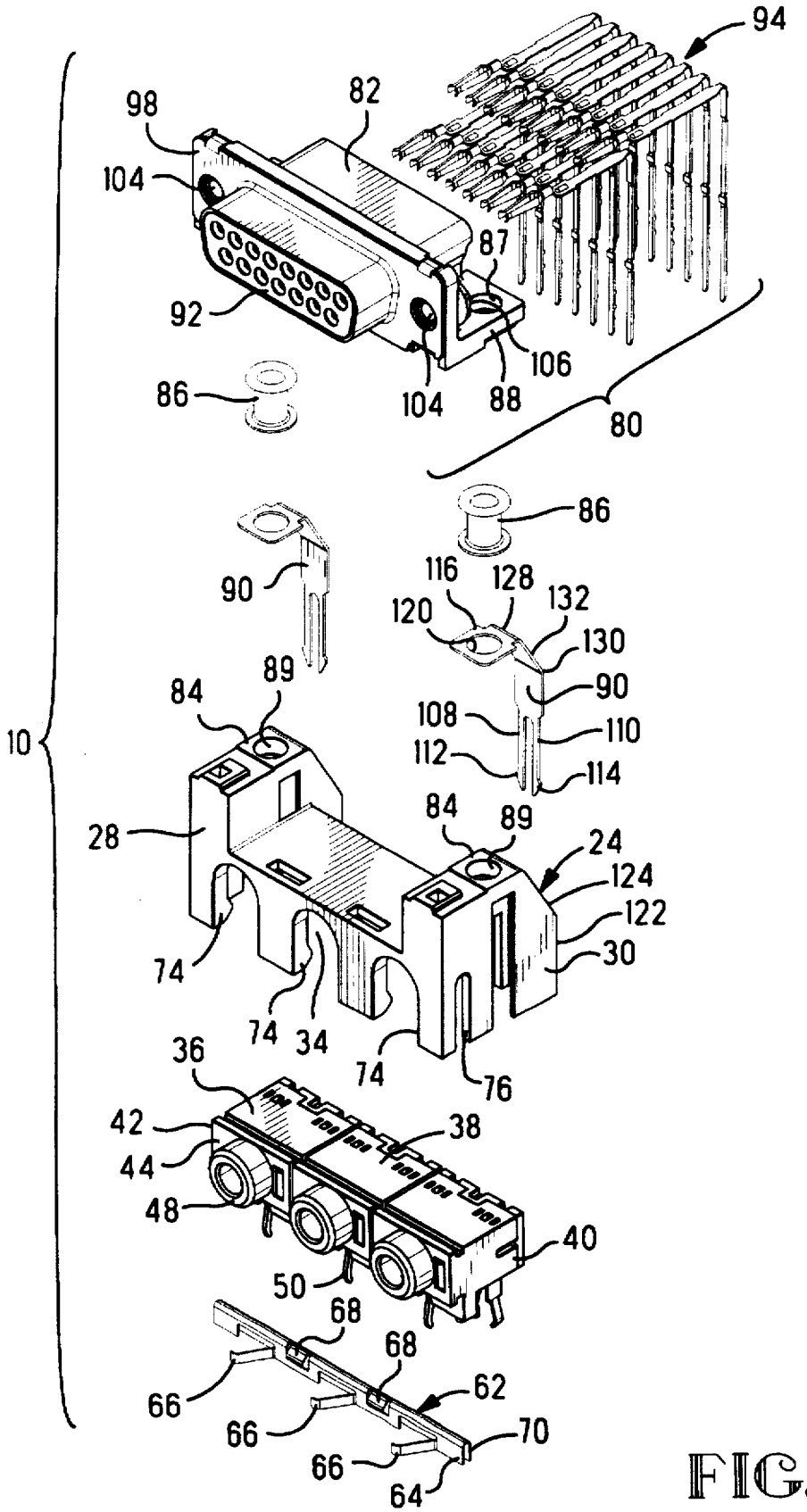
FIG. 2 is an exploded isometric view of the connector assembly of FIG. 1.
Figure 3:
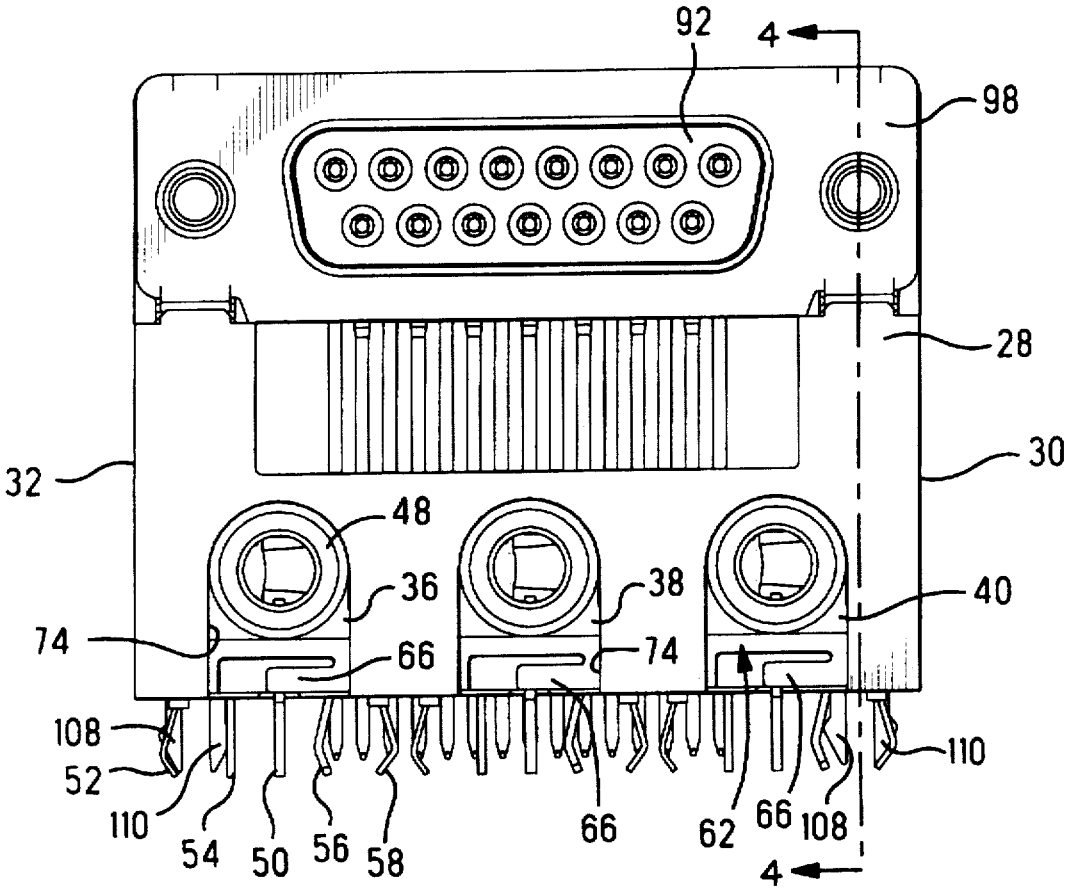
FIG. 3 is a front elevational view of the connector assembly of FIG. 1.
Figure 4:
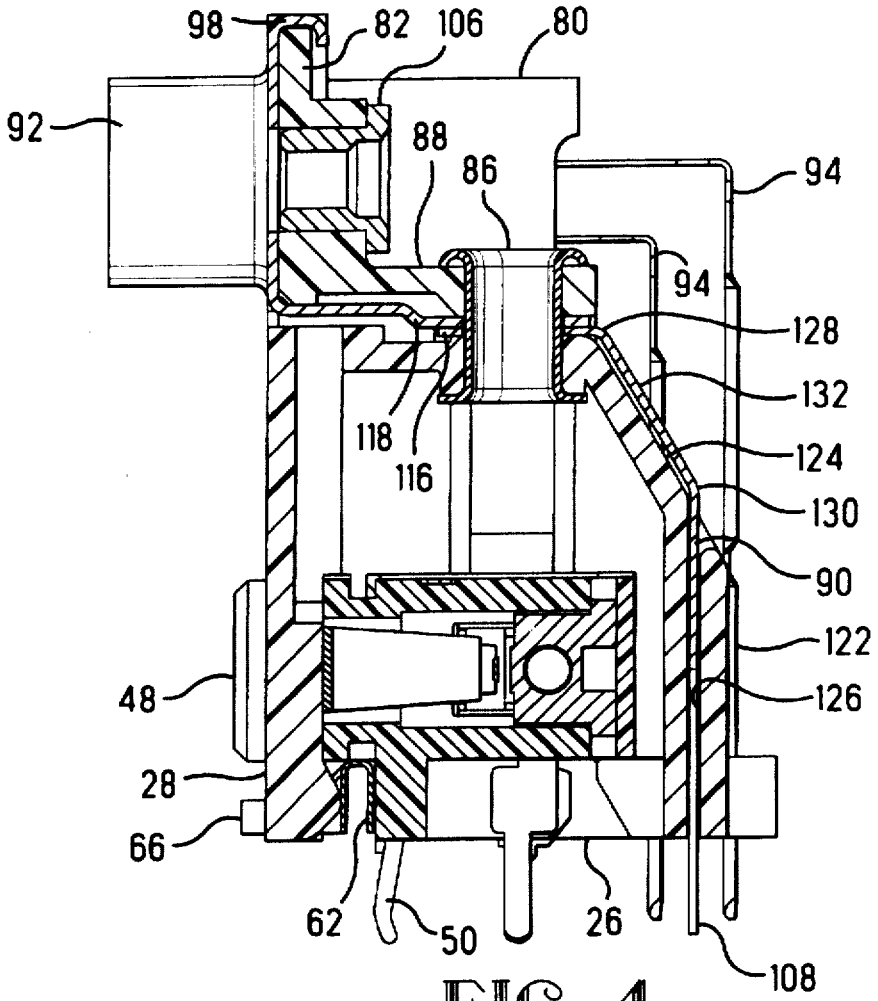
FIG. 4 is a cross sectional view taken along the line 4—4 of FIG. 3.

The housing 82 of the connector 80 has a forward mating end 92 which extends beyond the front wall 28 of the housing spacer 24 and through the opening 16 of the panel 14 for engagement with a complementary mating connector, as is conventional. Within the connector housing 82, and exposed at the mating end 92, are a plurality of contacts 94 which are held in a defined array for frictional engagement with respective contacts of the mating connector. Within the connector housing 82, these contacts 94 extend parallel to the circuit board 12 and are bent at right angles outside the housing 82, as best shown in FIGS. 2 and 4, for connection to the circuit board 12 through the openings 95, where they are soldered to traces on the board 12. The housing spacer 24 of the connector assembly 10 is further formed with a plurality of spacer elements 96 at the mounting face 26 and between the side walls 30, 32. These spacer elements 96 include slots for holding the contacts 94 in a fixed array corresponding to the defined array at the mating end 92, as is clear from FIG. 1. The connector 80 further includes a metal shroud 98 surrounding the mating end 92 and covering the front face of the housing 82. When the connector assembly 10 is installed, the metal shroud 98 engages the rear surface of the metal panel 14 Further, the screws 100 are inserted through respective openings 102 in the panel 14 and through respective openings 104 in the shroud 98 and the housing 82 and are secured by nuts 106 mounted to the back of the housing 82 to further secure the connector assembly 10 and clamp the shroud 98 to the panel 14.

In accordance with the principles of this invention, there is provided for each end of the assembly 10 a combined ground strap and board lock 90. In a first embodiment of the element 90, as shown in FIGS. 1 to 4, the combined ground strap and board lock 90 is a conductive metal strip with a pair of parallel spaced longitudinally extending tines 108, 110 at a first end. Along the outer lateral edge of each of the tines 108,110 is a respective outwardly extending barb 112,114. The barbs 112,114 are designed for interfering engagement with the hole 91 in the circuit board 12. Thus, when the tines 108,110 are inserted into the hole 91, the angled forward edges of the barbs 112,114 engage the periphery of the hole 91 and cause the tines 108,110 to be resiliently displaced toward each other. As the barbs 112,114 emerge from the hole 91 on the other side of the circuit board 12, the lateral force on the tines 108,110 is released and the tines 108,110 spread apart, with the barbs 112,114 interfering with subsequent removal of the combined ground strap and board lock 90 from the hole 91. The assembly is further secured when the combined ground strap and board lock 90 is soldered to a ground trace on the board 12.

The other end 116 of the element 90 is adapted for engagement with the metal shroud 98. Accordingly, the metal shroud 98 is formed with a pair of tabs 118 which extend rearwardly under the flanges 88. At their rear extremities, the tabs 118 are formed with openings (not shown) which align with the openings 87 in the flanges 88. The combined ground strap and board lock 90 is formed with an opening 120 at its end 116. During assembly, the end 116 is placed on the upper face 84 of the housing spacer 24 with the opening 120 aligned with the opening 89. The connector 80 is then placed on the upper face 84 with its opening 87 aligned with the openings 120 and 89. The rivets 86 are then installed through the set of aligned openings to secure the connector 80 to the housing spacer 24, with the end 116 of the combined ground strap and board lock 90 clamped between the tab 118 of the shroud 98 and the upper face 84 of the housing spacer 24. This provides secure conductive engagement between the metal shroud 98 and the combined ground strap and board lock 90.

As best shown in FIG. 4, the housing spacer 24 has a rear wall 122 orthogonal to the mounting face 26 and the upper face 84, and further has a support surface 124 joining the upper face 84 to the rear wall 122. The support surface 124 extends from the upper face 84 at a point adjacent an end of the flange 88 to the rear wall 22 and is at respective acute uppers to both the upper face 84 and the rear wall 122. The housing spacer 24 is formed with a slit-like opening 126 which extends parallel to the rear wall 122 from the support surface 124 to the mounting face 26. The combined ground strap and board lock 90 is bent at two places 128,130 at those same acute angles so that when its end 116 rests on the upper face 84, the tines 108,110 extend through the slit-like opening 126 and its central portion 132 is adjacent and parallel to the support surface 124. It has been found that by having those two bends 128,130 on the combined ground strap and board lock 90, this reduces the induced play when the element 90 is inserted in the hole 91 of the circuit board 12 as compared with the case if the element 90 had a single right angle bend.

Figure 5:
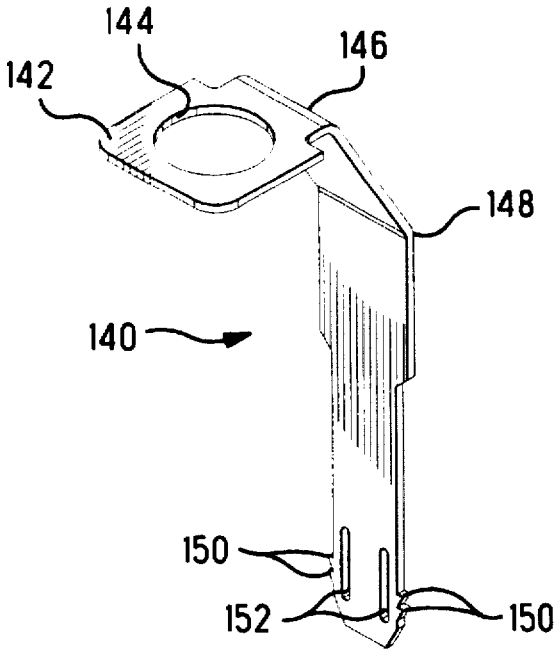
FIG. 5 is an isometric view of a second embodiment of the inventive combined ground strap and board lock.

FIG. 5 illustrates a second embodiment of an inventive combined ground strap and board lock, designated by the reference numeral 140. As with the combined ground strap and board lock 90, the combined ground strap and board lock 140 has an end 142 having an opening 144 adapted to rest on the upper face 84 of the housing 24 and be connected to the tab 118 of the metal shroud 98. It is further formed with two bends 146 and 148, which correspond to the bends 128 and 130, respectively, of the element 90. However, instead of the tines of the element 90, the combined ground strap and board lock 140 has outwardly extending barbs 150 for interfering insertion into the opening 91 of the circuit board 12 and a pair of longitudinally extending closed-ended slots 152 between the sets of barbs 150 for allowing temporary inward resilient deformation of the element 140 outwardly of slots 152 as the barbs 150 pass through the opening 91 of the circuit board 12.

Accordingly, there has been disclosed an improved combined ground strap and board lock for an electrical connector assembly. While illustrative embodiments of this invention have been disclosed herein, it is understood that various modifications and adaptations to the disclosed embodiments are possible, and it is intended that this invention be limited only by the scope of the appended claims.

What is claimed is:

1. An electrical connector assembly (10) adapted for mounting to a circuit board (12), the assembly comprising:

an electrical connector (80) including:

an insulating connector housing (82) having a forward mating end (92) for engagement with a complementary mating connector;

a plurality of contacts (94) disposed in said connector housing and exposed at said forward mating end in a defined array for frictional engagement with respective contacts of said mating connector; and a metal shroud (98) surrounding said forward mating end for shielding said plurality of contacts;

an insulative housing spacer (24) having a mounting face (26) for engaging the circuit board and an upper face (84) parallel to and spaced from said mounting face;

means (86) for mounting said connector housing to said upper face of said housing spacer;

a combined ground strap and board lock (90) including a conductive metal strip having at least one outwardly extending barb (112,114) along a lateral edge at a first end of said strip for interfering engagement with a hole (91) in said circuit board; and said connector housing is formed with a flange (88) adapted to overly said housing spacer upper face (84);

said metal shroud includes a tab (118) extending under said flange; and said mounting means is effective to clamp said flange to said upper face with said metal strip other end (116) between said spacer housing upper face and said metal shroud tab.

2. The assembly according to claim 1 wherein said metal strip is formed at said first end with a pair of spaced parallel longitudinally extending tines (108,110) each having at least one outwardly extending barb (112,114) on a lateral edge.

3. The assembly according to claim 1 wherein said metal strip includes on each lateral edge at said first end at least one outwardly extending barb (150) and between the barbs on opposed lateral edges said metal strip is formed with at least one longitudinally extending closed-ended slot (152) permitting temporary inward resilient deformation of opposed first end portions adjacent said lateral edges during insertion of said first end into a corresponding said circuit board hole (91).

4. The assembly according to claim 1 wherein said metal strip is adapted to be inserted into a strip-receiving opening (126) that extends through said housing spacer upwardly from said mounting face to proximate said upper face thereof, and the metal strip being further adapted to self retain therein.

5. The assembly according to claim 1 wherein:

said housing spacer has a rear wall (122) orthogonal to said mounting face and to said upper face;

said housing spacer has a support surface (124) joining said upper face to said rear wall, said support surface extending from said upper face at a point adjacent an end of said connector housing spacer flange to said rear wall, said support surface being at respective acute angles to both said upper face and said rear wall;

said housing spacer is formed with an opening (126) extending parallel to said rear wall from said support surface to said mounting face; and said metal strip extends through said housing spacer opening and is bent in multiple places (128 130) at said respective acute angles so as to be adjacent and parallel to said support surface.

6. The assembly according to claim 1 wherein a fastener (86) joins the connector housing (82) to said housing spacer (24) and is effective to clamp said metal strip other end (116) between said housing spacer upper face (84) and said metal shroud tab (118) and against said metal shroud tab to establish a ground connection.

7. The assembly according to claim 6 wherein said fastener (86) is a rivet extending through holes of the metal shroud tab (118) and said metal strip other end (116).

8. An electrical connector assembly (10) adapted for mounting to a circuit board (12), the assembly comprising:

an electrical connector (80) including:

an insulating connector housing (82) having a forward mating end (92) for engagement with a complementary mating connector;

a plurality of contacts (94) disposed in said connector housing and exposed at said forward mating end in a defined array for frictional engagement with respective contacts of said mating connector; and a metal shroud (98) surrounding said forward mating end for shielding said plurality of contacts;

an insulative housing spacer (24) having a mounting face (26) for engaging the circuit board and an upper face (84) parallel to and spaced from said mounting face;

means (86) for mounting said connector housing to said upper face of said housing spacer;

a combined ground strap and board lock (90) including a conductive metal strip having at least one outwardly extending barb (112,114) along a lateral edge at a first end of said strip for interfering engagement with a hole (91) in said circuit board; and means for conductively engaging the other end (116) of said metal strip with said metal shroud;

said housing spacer provides a clearance for a vertical portion of said metal strip that is orthogonal to said mounting face and to said upper face, and further has a support surface (124) joining said upper face to said clearance at respective acute angles, and said metal strip is bent at least at a location (130) at an acute angle from a vertical portion depending to said first end to resist upward deflection by the vertical portion during insertion of said first end into a respective said hole (91).

9. The assembly according to claim 8 wherein said clearance is an opening (126) extending from said support surface to said mounting face within which is contained said vertical metal strip portion.

10. The assembly according to claim 8 wherein said metal strip is bent at a second location (128) at an acute angle for a horizontal portion thereof to lie adjacent said upper face (84) of said housing spacer.

11. The assembly according to claim 10 wherein said metal strip horizontal portion comprises said other end (116) thereof, and extends under a flange (88) of said connector housing overlying said housing spacer upper face (84); and said mounting means is effective to clamp said flange to said upper face with said metal strip other end between said spacer housing upper face and a metal shroud tab (118).

* * * * *